US006167971B1

(12) United States Patent
Van Lingen

(10) Patent No.: US 6,167,971 B1
(45) Date of Patent: Jan. 2, 2001

(54) FIRE PROTECTION SYSTEM

(76) Inventor: Paul Van Lingen, P.O. Box 5706, Fullerton, CA (US) 92635-0706

( * ) Notice: Under 35 U.S.C. 154(b), the term of this patent shall be extended for 0 days.

(21) Appl. No.: 09/167,428

(22) Filed: Oct. 6, 1998

(51) Int. Cl.[7] ..... A62C 35/13; B05B 15/06

(52) U.S. Cl. ..... 169/16; 239/209

(58) Field of Search ..... 169/16, 5; 239/208, 239/209

(56) References Cited

U.S. PATENT DOCUMENTS

| | | | | |
|---|---|---|---|---|
| 1,489 | * | 10/1840 | Lowell | 169/16 |
| 218,100 | * | 7/1879 | Whyler | 239/208 X |
| 647,875 | * | 4/1900 | Piepenbrink | 169/16 |
| 1,507,350 | * | 9/1924 | Franzen | 239/208 X |
| 1,620,142 | * | 3/1927 | Thompson | 239/208 |
| 3,576,212 | * | 4/1971 | Siler | 169/16 X |
| 3,583,490 | * | 6/1971 | McFadden | 169/16 X |
| 3,858,618 | * | 1/1975 | Kaufman | 169/16 X |
| 4,330,040 | * | 5/1982 | Ence et al. | 239/209 X |
| 5,083,618 | * | 1/1992 | Hayes | 169/16 X |
| 5,165,482 | * | 11/1992 | Smagac et al. | 169/16 X |
| 5,692,571 | * | 12/1997 | Jackson | 169/16 |
| 5,732,511 | * | 3/1998 | Scott | 239/209 X |

FOREIGN PATENT DOCUMENTS

141345 * 11/1934 (AT) ..... 239/208

* cited by examiner

*Primary Examiner*—Lesley D. Morris

(57) ABSTRACT

A fire protection system for a building having a periphery with a roof situated thereon. The roof is supported by rafters which are angled downwardly from a ridge to at least one eave thereof. The eave extends beyond the periphery of the building a predetermined distance. Included as components of the invention are a water supply for supplying water and a plurality of supply pipes connected at a first end thereof to the water supply and extending to the building such that the water may flow from the reservoir tank to the building. Also included is a plurality of above ground distribution pipes. The above ground distribution pipes include at least one vertical pipe situated vertically on the periphery of the building with a lower end thereof connected to a second end of the underground pipe and a plurality of horizontal pipes connected to an upper end of the vertical pipe and extending along the length of the eave on an underside thereof. A plurality of sprinklers are connected to the horizontal pipes of the above ground distribution pipes to spray water upwardly towards the rafters and downwardly towards the windows of the building upon the supply of water thereto. Finally, a pump is included which is adapted to effect the flow of the water from the reservoir tank through the pipes and to the sprinklers upon the receipt of an activation signal.

1 Claim, 3 Drawing Sheets

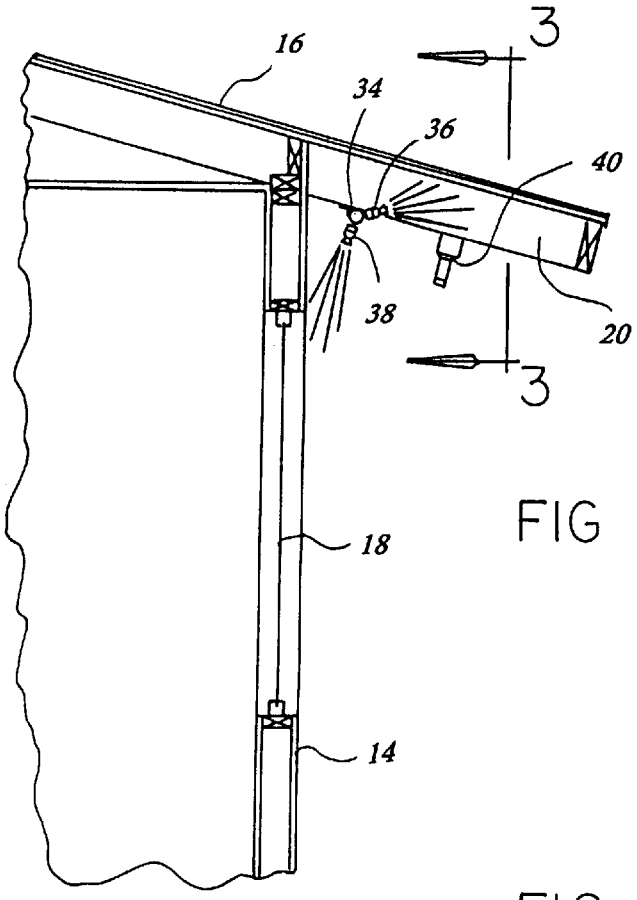
FIG 2
FIG 3
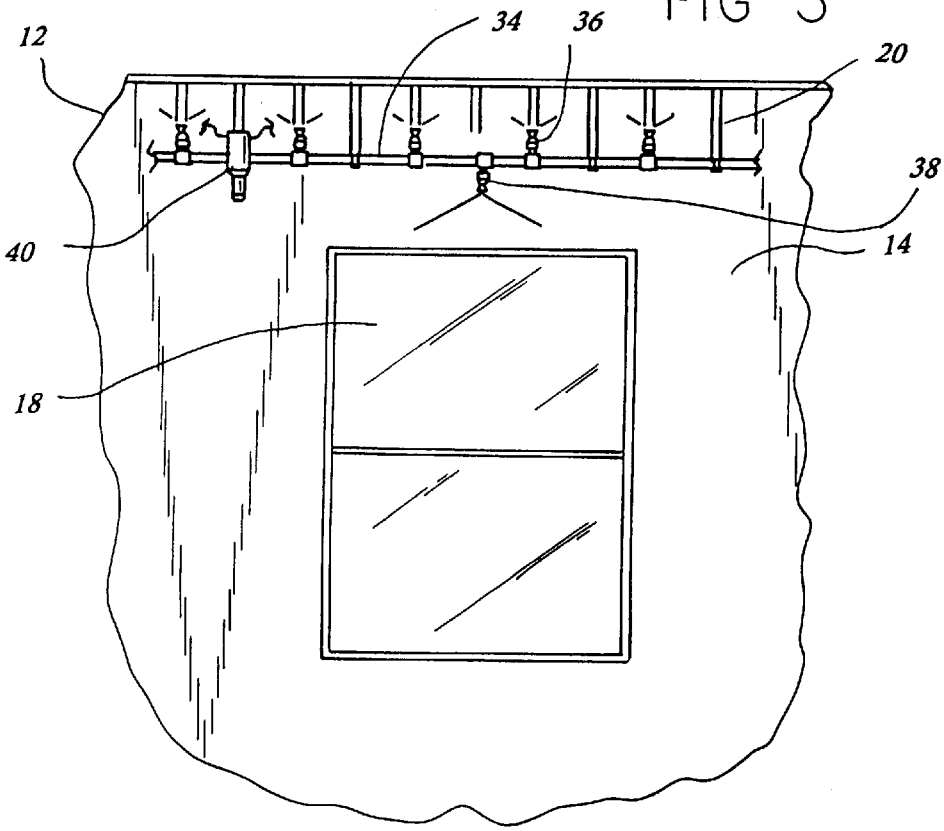

FIG 4
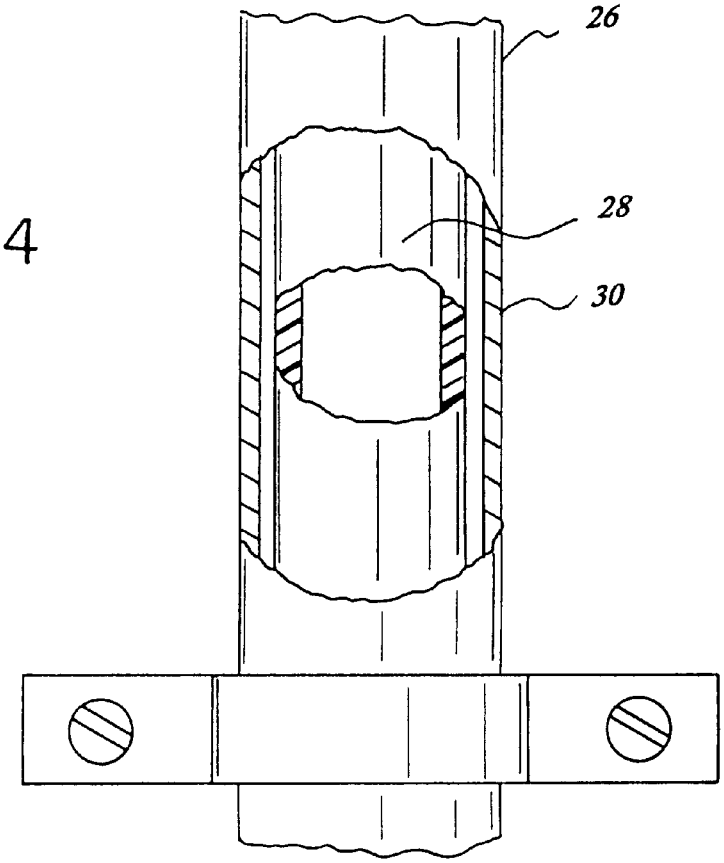
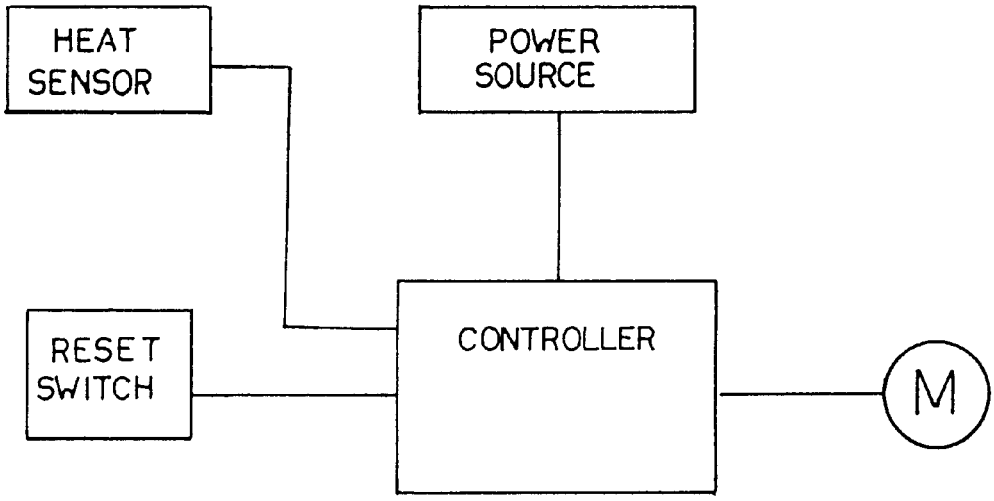
FIG 5

FIRE PROTECTION SYSTEM

BACKGROUND OF THE INVENTION

1. Field of the Invention

The present invention relates to a fire protection system and more particularly pertains to deluging portions of a building which are not protected by means of fire retardant material such as windows and eaves.

2. Description of the Prior Art

The use of roof sprinklers is known in the prior art. More specifically, roof sprinklers heretofore devised and utilized for the purpose of protecting a roof from wild fires are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,125,458 to Berman; U.S. Pat. No. 4,175,703 to Valiant; U.S. Pat. No. 4,453,155 to Cooper; and U.S. Pat. No. 4,428,434 to Gelaude.

In this respect, the fire protection system according to the present invention substantially departs from the conventional concepts and designs of the prior art, and in so doing provides an apparatus primarily developed for the purpose of deluging portions of a building which are not protected by means of fire retardant material such as windows and eaves.

Therefore, it can be appreciated that there exists a continuing need for a new and improved fire protection system which can be used for deluging portions of a building which are not protected by means of fire retardant material such as windows and eaves. In this regard, the present invention substantially fulfills this need.

SUMMARY OF THE INVENTION

In view of the foregoing disadvantages inherent in the known types of roof sprinklers now present in the prior art, the present invention provides an improved fire protection system. As such, the general purpose of the present invention, which will be described subsequently in greater detail, is to provide a new and improved fire protection system which has all the advantages of the prior art and none of the disadvantages.

To attain this, the present invention essentially comprises a building having a periphery with a roof situated thereon and a plurality of windows. The roof is supported by rafters which are angled downwardly from a ridge to at least one eave thereof. At least one eave extends beyond the periphery of the building a predetermined distance. It should be noted that the roof and the periphery are constructed from a fire retardant material. As shown in FIG. 1, a reservoir tank is included. Such tank comprises a cylindrical tank positioned distant the building above the ground. In use, the reservoir tank is adapted to contain a predetermined amount of water. With reference still to FIG. 1, a plurality of underground supply pipes are included each formed of PVC connected at a first end thereof to the reservoir. Such supply pipes extend to the building so that the water may flow from the reservoir tank to the building. Further provided is a plurality of above ground distribution pipes. Each above ground distribution pipe is formed of PVC with a metallic covering for protection against UV radiation. Note FIG. 4. The above ground distribution pipes include at least one vertical pipe situated vertically on the periphery of the building, as shown in FIG. 1. A lower end of the at least one vertical pipe is connected to a second end of the underground pipe. The distribution pipes further include a plurality of horizontal pipes connected to an upper end of the vertical pipe and extended along the length of the at least one eave on an underside thereof. See FIGS. 2–3. With reference still to FIGS. 2–3, a plurality of rafter sprinklers are connected to the horizontal pipes of the above ground distribution pipes. Preferably, there is one rafter sprinkler for every two rafters. By this design, the rafter sprinklers are adapted to spray water upwardly towards the rafters upon the supply of water thereto. It should be noted that each rafter sprinkler has a first predetermined breadth of spray dependent on spacing between the rafters. Also included is a plurality of window sprinklers connected to the horizontal pipes of the above ground distribution pipes above each of the windows of the building. The window sprinklers are each adapted to spray water downward on to an associated window upon the supply of water thereto. Each window sprinkler has a second predetermined breadth of spray dependent on the width of the windows. A pump is included to effect the flow of the water from the reservoir tank through the pipes and to the sprinklers upon the receipt of an activation signal. For transmitting a heat detection signal upon a surrounding temperature surpassing a predetermined amount, at least one heat sensor is situated beneath the at least one eave. A reset switch is adapted to generate a reset signal upon the depression thereof. Finally, a controller is connected to the pump, the heat sensor, and the reset switch. In operation, the controller is adapted for transmitting to the pump an activation signal upon the receipt of a heat detection signal. The controller continues to transmit the activation signal until the receipt of the reset signal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fire protection system which has all the advantages of the prior art roof sprinklers and none of the disadvantages.

It is another object of the present invention to provide a new and improved fire protection system which may be easily and efficiently manufactured and marketed.

It is a further object of the present invention to provide a new and improved fire protection system which is of a durable and reliable construction.

An even further object of the present invention is to provide a new and improved fire protection system which is susceptible of a low cost of manufacture with regard to both materials and labor, and which accordingly is then susceptible of low prices of sale to the consuming public, thereby making such fire protection system economically available to the buying public.

Still yet another object of the present invention is to provide a new and improved fire protection system which provides in the apparatuses and methods of the prior art some of the advantages thereof, while simultaneously overcoming some of the disadvantages normally associated therewith.

Still another object of the present invention is to deluge portions of a building which are not protected by means of fire retardant material such as windows and eaves.

Lastly, it is an object of the present invention to provide a new and improved fire protection system for a building having a periphery with a roof situated thereon. The roof is supported by rafters which are angled downwardly from a ridge to at least one eave thereof. The eave extends beyond the periphery of the building a predetermined distance. Included as components of the invention are a water supply for supplying water and a plurality of supply pipes connected at a first end thereof to the water supply and extending to the building such that the water may flow from the reservoir tank to the building. Also included is a plurality of above ground distribution pipes. The above ground distribution pipes include at least one vertical pipe situated vertically on the periphery of the building with a lower end thereof connected to a second end of the underground pipe and a plurality of horizontal pipes connected to an upper end of the vertical pipe and extending along the length of the eave on an underside thereof. A plurality of sprinklers are connected to the horizontal pipes of the above ground distribution pipes to spray water upwardly towards the rafters and downwardly towards the windows of the building upon the supply of water thereto. Finally, a pump is included which is adapted to effect the flow of the water from the reservoir tank through the pipes and to the sprinklers upon the receipt of an activation signal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a cross-sectional view of the rafters and sprinklers taken along line 2—2 shown in FIG. 1.

FIG. 3 is a front view of the window and sprinklers of the present invention.

FIG. 4 is a cut away view of one of the above ground distribution pipes.

FIG. 5 is a schematic diagram depicting the various components of the present invention.

Similar reference characters refer to similar parts throughout the several views of the drawings.

DESCRIPTION OF THE PREFERRED EMBODIMENT

Figure 1:
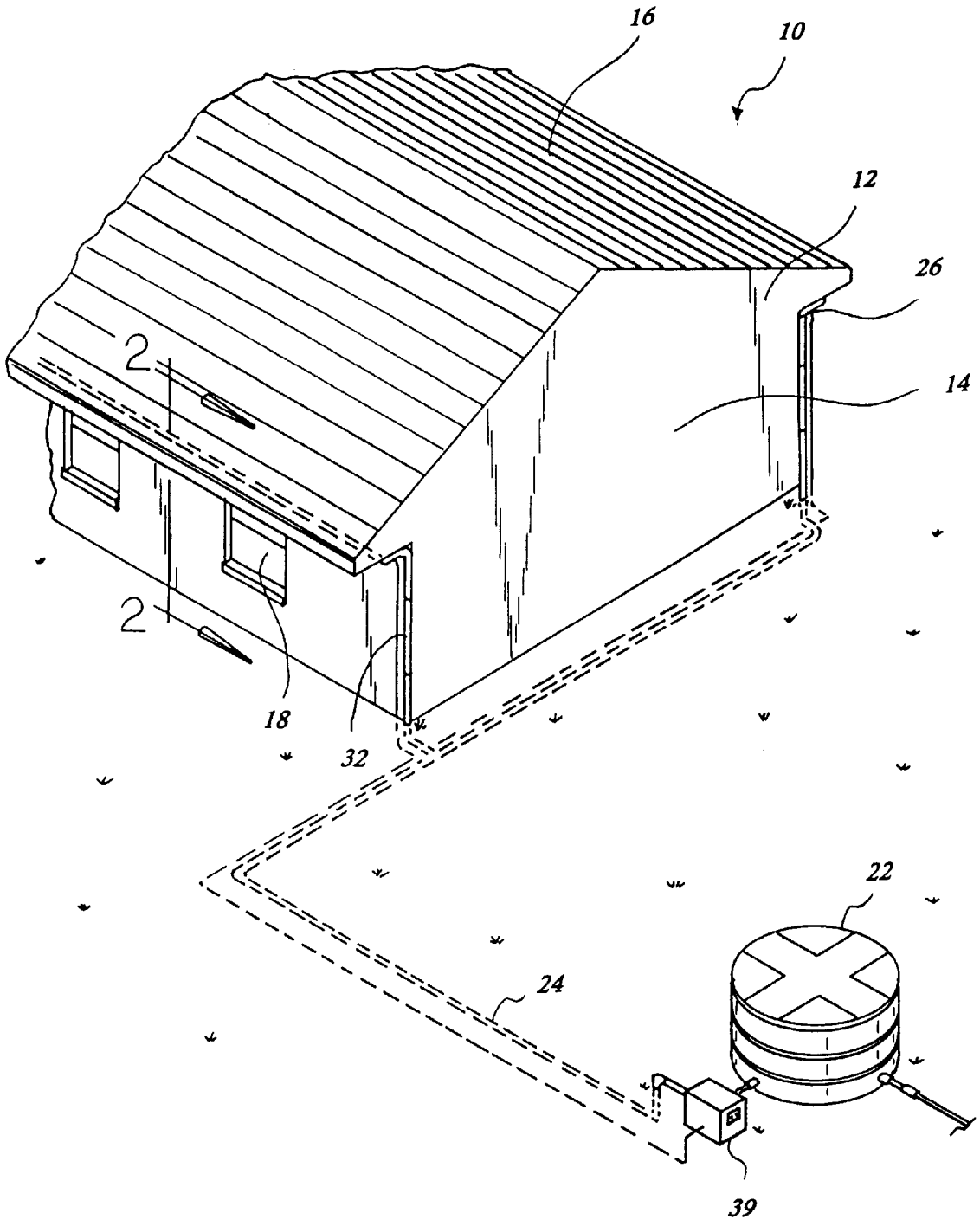
FIG. 1 is a perspective illustration of the preferred embodiment of the fire protection system constructed in accordance with the principles of the present invention.

With reference now to the drawings, and in particular to FIG. 1 thereof, a new and improved fire protection system embodying the principles and concepts of the present invention and generally designated by the reference numeral 10 will be described.

The present invention, the new and improved fire protection system, is comprised of a plurality of components. Such components in their broadest context include a reservoir tank, a plurality of supply pipes, a plurality of distribution pipes, rafter sprinklers, window sprinklers, pump, heat sensor, reset switch, and controller. Such components are individually configured and correlated with respect to each other so as to attain the desired objective.

More specifically, it will be noted that the system 10 of the present invention includes a building 12 having a periphery 14 with a roof 16 situated thereon and a plurality of windows 18. The roof is supported by rafters 20 which are angled downwardly from a ridge to at least one eave thereof. At least one eave extends beyond the periphery of the building a predetermined distance. It should be noted that the roof and the periphery are constructed from a fire retardant material.

As shown in FIG. 1, a reservoir tank 22 is included. Such tank comprises a cylindrical tank positioned distant the building above the ground. In use, the reservoir tank is adapted to contain a predetermined amount of water. In the alternative, a natural body of water or a pool may be utilized as a source of water. Ideally, the source of water is capable of supplying water for a period of no less than 30 minutes.

With reference still to FIG. 1, a plurality of underground supply pipes 24 are included each formed of PVC connected at a first end thereof to the reservoir. Such supply pipes extend to the building so that the water may flow from the reservoir tank to the building.

Further provided is a plurality of above ground distribution pipes 26. Each above ground distribution pipe is formed of PVC 28 with a metallic covering 30 for protection against UV radiation and heat associated with a fire. Note FIG. 4. The above ground distribution pipes include at least one vertical pipe 32 situated vertically on the periphery of the building, as shown in FIG. 1. A lower end of the at least one vertical pipe is connected to a second end of the underground pipe. The distribution pipes further include a plurality of horizontal pipes 34 connected to an upper end of the vertical pipe and extended along the length of the at least one eave on an underside thereof. See FIGS. 2–3. As shown in FIG. 4, a plurality of brackets are utilized to secure the horizontal pipes in their operable position. Ideally, the brackets are installed a maximum of 6'-0" on center.

With reference to FIGS. 2–3, a plurality of rafter sprinklers 36 are connected to the horizontal pipes of the above ground distribution pipes. Preferably, there is one rafter sprinkler for every two rafters. By this design, the rafter sprinklers are adapted to spray water upwardly towards the rafters upon the supply of water thereto. It should be noted that each rafter sprinkler has a first predetermined breadth of spray dependent on the spacing between the rafters. Such breadth is approximately 75 degrees. Ideally, K-Ball TM Model BFL 10 sprinklers are utilized for the rafter sprinklers.

For substantially reducing radiant heat from an advancing flame front, a plurality of window sprinklers 38 are connected to the horizontal pipes of the above ground distribution pipes above each of the windows of the building. The window sprinklers are each adapted to spray water downward on to an associated window upon the supply of water thereto. Each window sprinkler has a second predetermined breadth of spray dependent on the width of the windows. Such breadth may be adjusted within a range of 25–110 degrees. It is preferred that K-Ball TM Model BF110609 Flat-V sprinklers are utilized for the rafter sprinklers. It should be noted that by utilizing such sprinklers, a user may adjust the direction of spray within a range of 52 degrees. As such, the spray may be focused on corners of the roof and other hard to reach areas. It should be noted that the horizontal pipes and associated sprinklers should be situated approximately ¼ the distance of the rafters from the periphery of the building to ensure optimal spraying of both the window and rafters.

A pump 39 is included to effect the flow of the water from the reservoir tank through the pipes and to the sprinklers upon the receipt of an activation signal. The pump is preferably powered by an independent generator which does not rely on outside sources of power. The pump is further adapted to afford a water pressure of approximately 100 PSI. So that the sprinklers will operate properly, a pressure of no less than 15 PSI is required.

For transmitting a heat detection signal upon a surrounding temperature surpassing a predetermined amount, at least one heat sensor 40 is situated beneath the at least one eave. Ideally, a Notifier TM Model# 302-AW-135 or 302-ET-135 is utilized to afford a heat sensor ideally suited for outdoor use. It should be noted that by positioning the heat sensor beneath the eave, inadvertent transmission of the heat detection signal due to intense sunlight is adverted.

A reset switch 42 is adapted to generate a reset signal upon the depression thereof. Such reset switch is preferably situated within the building.

Finally, a controller 46 is connected to the pump, the heat sensor, and the reset switch. In operation, the controller is adapted for transmitting to the pump an activation signal upon the receipt of a heat detection signal. The controller continues to transmit the activation signal until the receipt of the reset signal or until the water of the water supply is completely used.

The present invention is especially suited to deluge portions of a building which are not protected by means of fire retardant material such as windows and eaves.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A fire protection system comprising, in combination:

a building having a periphery with a roof situated thereon and a plurality of windows, the roof supported by rafters which are angled downwardly from a ridge to at least one eave thereof, wherein at least one eave extends beyond the periphery of the building a predetermined distance;

said roof and said periphery being constructed from a fire retardant material;

a reservoir tank comprising a cylindrical tank positioned distant the building above the ground, the reservoir tank adapted to contain a predetermined amount of water;

a plurality of underground supply pipes formed of PVC connected at a first end thereof to the reservoir and extending to the building such that the water may flow from the reservoir tank to the building;

a plurality of above ground distribution pipes, each above ground distribution pipe formed of PVC with an imperforate metallic covering for protection against UV radiation, the above ground distribution pipes including at least one vertical pipe situated vertically on the periphery of the building with a lower end thereof connected to a second end of the underground pipe and a plurality of horizontal pipes connected to an upper end of the vertical pipe and extending along the length of at least one eave on an underside thereof;

a plurality of rafter sprinklers connected to the horizontal pipes of the above ground distribution pipes such that there is one rafter sprinkler for every two rafters, the rafter sprinklers being located between the rafters and having outlet orifices facing upwardly and adapted to spray water towards the rafters on opposite sides thereof upon the supply of water thereto, wherein each rafter sprinkler has a first predetermined breadth of spray dependent on spacing between the rafters;

a plurality of window sprinklers connected to the horizontal pipes of the above ground distribution pipes above each of the windows of the building, the window sprinklers each having outlet orifices facing downwardly adapted to spray water on to an associated window upon the supply of water thereto, wherein each window sprinkler has a second predetermined breadth of spray greater than the first predetermined breadth of spray dependent on the width of the windows, the rafter sprinklers and window sprinklers having inlet orifices at a common elevational orientation;

a pump adapted to effect the flow of the water from the reservoir tank through the pipes and to the sprinklers upon the receipt of an activation signal;

at least one heat sensor situated beneath at least one eave for transmitting a heat detection signal upon a surrounding temperature surpassing a predetermined amount;

a reset switch adapted to generate a reset signal upon the depression thereof; and a controller connected to the pump, the heat sensor, and the reset switch for transmitting to the pump an activation signal upon the receipt of a heat detection signal, whereby the controller continues to transmit the activation signal until the receipt of the reset signal.

* * * * *